United States Patent [19]

Mayer et al.

[11] 3,938,473

[45] Feb. 17, 1976

[54] STEAM GENERATOR HAVING FEED-WATER PREHEATER

[75] Inventors: Hans Mayer, Bubenreuth; Werner Nieschler, Erlangen, both of Germany

[73] Assignee: Siemens Aktiengesellschaft, Munich, Germany

[22] Filed: Jan. 17, 1974

[21] Appl. No.: 434,359

[30] Foreign Application Priority Data

Jan. 26, 1973 Germany ..... 2303875

[52] U.S. Cl. ..... 122/32; 122/34; 122/406 R

[51] Int. Cl. ..... F22b 1/06

[58] Field of Search ..... 165/112; 122/32, 34, 33, 122/406

[56] References Cited

UNITED STATES PATENTS

| | | | |
|---|---|---|---|
| 2,796,050 | 6/1957 | Rehm | 122/32 |
| 3,380,649 | 4/1968 | Roberts | 165/112 X |
| 3,483,848 | 12/1969 | Green | 122/32 |
| 3,672,444 | 6/1972 | Lowe | 122/32 |

*Primary Examiner*—Kenneth W. Sprague
*Attorney, Agent, or Firm*—Kenyon & Kenyon Reilly Carr & Chapin

[57] ABSTRACT

A steam generator has a preheater for preheating feed-water supplied from an external source, the preheater receiving its heat from the steam generator's heat exchanger. If the supply of feed-water to the steam generator is reduced while the heat exchanger maintains its heat output, the feed-water is overheated. To prevent this, some of the already heated feed-water in the steam generator is fed to the feed-water entering the preheater, this raising the feed-water's temperature relative to the temperature of the heat exchanger, reducing the rate of exchange of the heat from the heat exchanger to feed-water in the preheater, and by this control preventing overheating of the water in the preheater.

3 Claims, 1 Drawing Figure

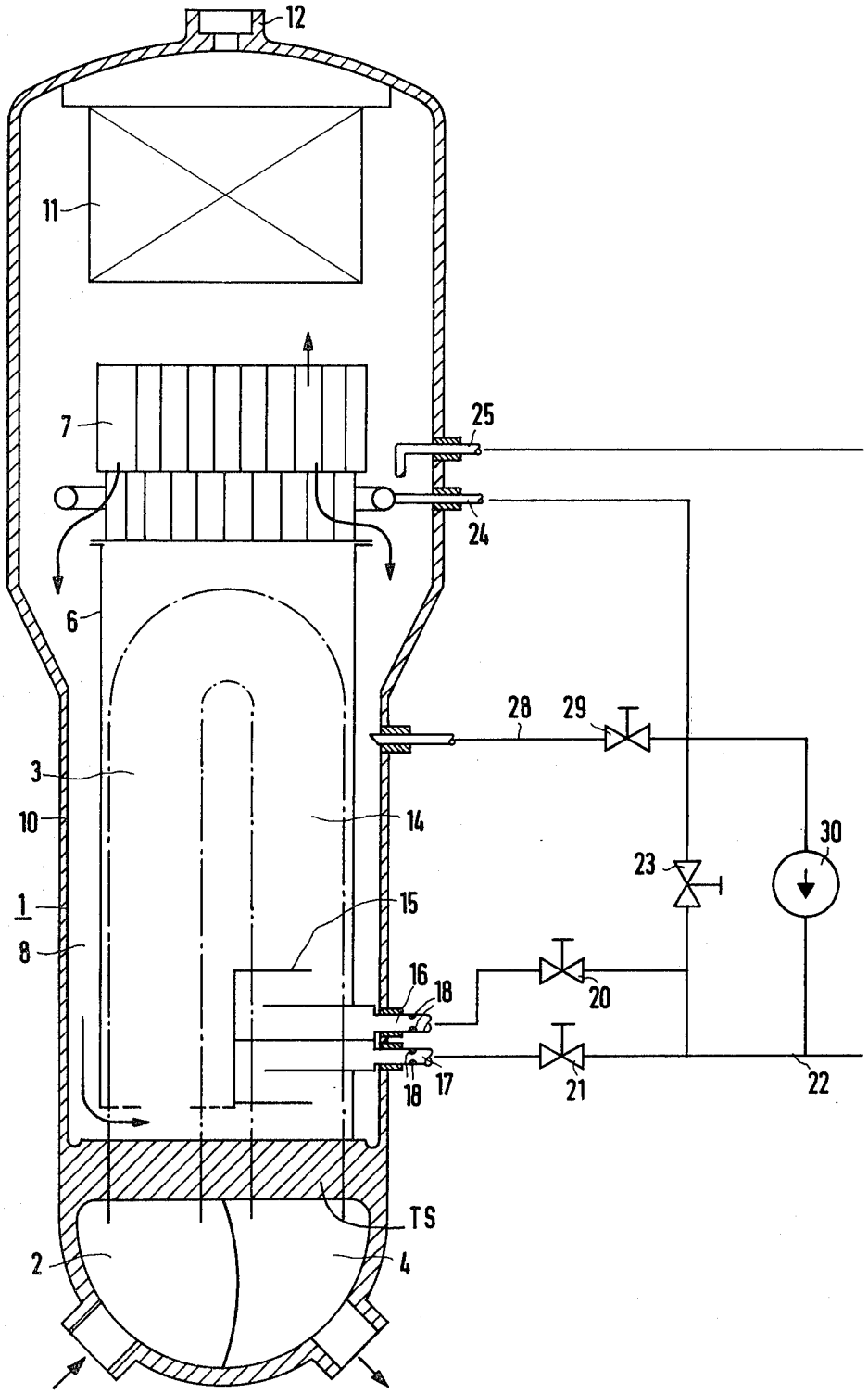
12
11
7
25
24
6
28
29
3
10
14
30
23
1
15
8
16
18
20
18
17
21
22
TS
2
4

STEAM GENERATOR HAVING FEED-WATER PREHEATER

BACKGROUND OF THE INVENTION

A steam generator for a pressurized-water reactor power plant is usually constructed with a vertical cylindrical feed-water casing having a top closed by a steam dome provided with a steam outlet and a bottom closed by a tube sheet in which are mounted the inlet and outlet legs of an inverted U-shaped tube bundle, the bottom of the tube sheet having inlet and outlet reactor water-coolant manifolds for circulating the coolant through the tube bundle via these inlet and outlet legs. The tube bundle is surrounded by a cylindrical shroud spaced radially inwardly from the casing to define a descent space, the bottom of the shroud having an opening via which this descent space connects with the shroud's interior. The casing has a feed-water input inlet maintaining a supply of feed-water in the casing, the feed-water rising within the shroud while heating, flowing from the top of the shroud and descending in the descent space to again ascend within the shroud. The top of the shroud usually has a steam-water separator which separates the steam vaporizing from the ascending water within the shroud and discharging separated water back into the descent space. This descending water retains a substantial amount of its heat.

To avoid thermal shock and provide increased efficiency, a feed-water preheater surrounds the lower end of the tube bundle's outlet leg and connects with a feed-water supply pipe line supplied with feed-water of adequate pressure for introduction to the generator's casing. This preheater receives its heat from the heat exchanger tube bundle's outlet leg and discharges preheated feed-water inside of the shroud above the tube sheet, thus avoiding thermal shock and increasing efficiency.

The rate the feed-water is fed depends on the steam output demand of the steam generator, and if this is reduced, the feed-water input rate must also be reduced. The heat exchanger is heated by the pressurized-water coolant from the reactor providing the heat exchanger with a substantially constant heat input. If the feed-water input rate must be reduced, the feed-water receives an excessive amount of heat from the heat exchanger during the preheating, thus overheating the feed-water, causing the feed-water to boil, and the feed-water with boiling precipitating out compounds inevitably included by the feed-water and which are corrosive with respect to the preheater and heat exchanger.

The above shows that there is a problem concerning the provision of some kind of control of the rate of heat exchange effected in the preheater between the heat exchanger and the feed-water going through the preheater at a flow rate reduced from a normal rate for which the steam generator and its preheater are designed.

SUMMARY OF THE INVENTION

An object of the present invention is to solve the above problem.

According to the invention, the problem is solved by when necessary for the control, removing some of the hot water descending in the descent space of the generator and introducing it to the feed-water entering the preheater. Thus, the preheater is fed with feed-water having a temperature substantially above its normal temperature with its feed at the higher and normal rate. However, because the rate of heat exchange between the heat exchanger's outlet leg and the feed-water flowing through the preheater depends on the temperature differential between the two, this increase in the temperature of the feed-water reduces this differential and, therefore, reduces the heat exchange rate, preventing the feed-water from overheating in the preheater.

The above effect is obtained by a pipe line connected to withdraw the hot water from the descent space at a substantial distance above the preheater, this pipe line via a pump connecting with the feed-water supply line going to the preheater. A valve in the pipe line, or other suitable means, controls the rate at which the hot water already heated within the generator, is withdrawn from the descent space and introduced to the feed-water supply pipe line. Under this control, the feed-water entering the preheater may be adjusted to a temperature lowering the rate of heat exchange between the heat exchanger and the feed-water in the preheater to a rate preventing boiling of the feed-water while flowing through the preheater.

BRIEF DESCRIPTION OF THE DRAWING

In the accompanying drawing the single FIGURE schematically shows in vertical section a steam generator of the type described having a feed-water preheater, and diagrammatically illustrating an embodiment of the invention.

DETAILED DESCRIPTION OF THE INVENTION

Referring to the above drawing, the steam generator is of the type used in a pressurized-water reactor power plant.

This generator is designated as a whole by the numeral 1. The water coolant from the reactor enters the inlet manifold 2, passes through the inverted U-shaped tube bundle 3 having its tube ends mounted in the tube sheet TS, and leaves via the outlet manifold 4. The tube sheet TS closes the bottom of the feed-water space within the generator.

The tube bundle 3 is surrounded by the cylindrical shroud 6 on top of which the steam-water separators 7 are mounted, the separated water flowing downwardly into the descent space 8 formed by the radial interspacing of the shroud 6 and the generator's casing. A fine separator 11 for the steam is mounted below the steam output outlet 12 of the steam generator casing 10, which encloses the feed-water.

The preheater is shown at 15 enclosing the outlet or cold leg 14 of the tube bundle 3, this preheater being connected with two feed-water input connection nipples 16 and 17 extending through the casing 10, each nipple having flow chokes 18.

The two feed-water inputs 16 and 17 feed the feed-water to the preheater 15, the flow from the input 16 going upwardly through the preheater and the flow from the input 17 going downwardly, but in both instances the water is sinuously guided around and between the various tubes of the lower portion of the leg 14. It is to be assumed that the preheater 15 is or can be designed so that when the steam generator is producing its rated output of steam the feed-water is preheated and is introduced to the feed-water ascending within the shroud 6, without a boiling problem.

Via valves 20 and 21 feed-water inlets 16 and 17 are respectively connected with a feed-water supply line 22 which connects with an unillustrated source of feed-water under adequate pressure and which may be water condensed from steam exhausted by a consumer, such as a turbine or the like. A valve 23 connects the supply line 22 with a feed-water inlet 24 of the type supplying an annular perforated pipe surrounding the water separator 7 and feeding directly into the descent space 8. This is mainly for the purpose of maintaining more exactly the desired water level in the generator's casing 10 above the top of the tube bundle heat exchanger 3. If the normal feeding arrangement fails, the inlet 25 can be used as an emergency feed line.

According to the invention, the descent space 8 at a level substantially above the preheater 15 and representing a space containing the hot feed-water discharged by the separator 7, has a connection via a pipe line 28 having an interposed control valve 29 and circulatingly powered by a pump 30, with the feed-water supply line 22. It is to be assumed that the pump 30 is driven by a motor and can be controlled as can the valve 29 and all of the other valves referred to.

If the steam generator 1 is operated under partial load, the danger exists below the given load level, such as below 50% of nominal loading, of the premature boiling of the feed-water flowing through the preheater 15. The feed-water flow rate must have its flow rate adjusted to the reduced production of steam and it, therefore, receives per unit of time a greatly increased amount of heat from the heat exchanger's outlet leg, the reactor coolant flow continuing through the heat exchanger.

Under the above conditions the pump 30 with the valve 29 open, or suitably controlled, is operated to remove the hot feed-water in the descent space 8, via the pipe line 28, and introduce it to the feed-water supply line 22 so that the temperature of the feed-water entering either of the inlets 16 and 17, respectively under the control of the valves 20 and 21, is increased to a degree reducing the heat exchange in the preheater 15. At the same time the amount of feed-water flowing through the preheater is increased, because of the forced circulation obtained by the pump 30 from the descent space 8 through the preheater, up through the space within the shroud 6 and back down the descent space and to the pipe line 28.

It follows from the foregoing that boiling can be prevented in the preheater 15 when the steam generator is operated under a reduced load, both by the heating of the feed-water entering the preheater to reduce the heat exchange rate effected within the preheater and also by the increased flow rate of the feed-water effected by the circulation via 28 and 29, pump 30, line 22, valves 20 or 21 and the feed-water inlets 16 and 17. Control of the various valves depends on the conditions existing in the preheater.

Via the valve 23 and the input connection 24 the described arrangement may also be used to increase the temperature of any feed-water introduced via the inlet 24 for discharge into the descent space 8. This discharge is, of course, above the level from which the hot water is withdrawn via the pipe 28.

Although not shown, the various valves and the pump control may be effected automatically by a suitable control system responsive to the conditions existing in the preheater.

What is claimed is:

1. A steam generator having an upstanding feed-water casing with a steam output outlet and enclosing an upstanding heat exchanger radially enclosed by a shroud forming a feed-water descent space by being spaced from the inside of said casing and having top and bottom openings so feed-water in said casing circulates by rising within said shroud and descending via said descent space, a feed-water preheater being heated by a lower portion of said heat exchanger and discharging into said shroud, and a feed-water input pipe line for said preheater extending through said casing for connection with an external source of feed-water; wherein the improvement comprises means for removing feed-water from said descent space at a location above said preheater and introducing it to said feed-water input pipe line to increase the temperature and flow rate of feed-water fed to said preheater and thereby lower the rate of heat exchanged thereto from said heat exchanger.

2. The steam generator of claim 1 in which said means comprises a pump having an intake connected by a pipe with said location and an output connected by a pipe with said feed-water input pipe line.

3. The steam generator of claim 2 in which said one of said pump's connecting pipes includes a control valve.

* * * * *